US009010919B2

(12) United States Patent
Izawa et al.

(10) Patent No.: US 9,010,919 B2
(45) **Date of Patent: *Apr. 21, 2015**

(54) INKJET RECORDING APPARATUS AND INKJET RECORDING METHOD USING THE SAME

(75) Inventors: Hideo Izawa, Chiba (JP); Kenji Takahashi, Chiba (JP); Yuuichi Yamazaki, Chiba (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 175 days.

This patent is subject to a terminal disclaimer.

(21) Appl. No.: 13/199,700

(22) Filed: Sep. 7, 2011

(65) Prior Publication Data

US 2012/0133715 A1 May 31, 2012

(30) Foreign Application Priority Data

Nov. 29, 2010 (JP) ..... 2010-265810

(51) Int. Cl.

| | |
|---|---|
| ***B41J 2/01*** | (2006.01) |
| ***B41J 3/60*** | (2006.01) |
| ***B41J 11/00*** | (2006.01) |
| ***B41J 15/16*** | (2006.01) |
| *B41J 3/407* | (2006.01) |

(52) U.S. Cl.

CPC . *B41J 3/60* (2013.01); *B41J 3/4078* (2013.01); *B41J 11/002* (2013.01); *B41J 15/165* (2013.01)

(58) Field of Classification Search

CPC ..... B41J 2/01

USPC ..... 347/96–102

See application file for complete search history.

(56) References Cited

U.S. PATENT DOCUMENTS

| | | | | |
|---|---|---|---|---|
| 5,764,263 | A * | 6/1998 | Lin | 347/101 |
| 6,601,951 | B2 * | 8/2003 | Kuwabara et al. | 347/101 |
| 6,659,602 | B2 * | 12/2003 | Izawa et al. | 347/102 |
| 6,736,935 | B2 * | 5/2004 | Hermans et al. | 162/109 |
| 8,371,689 | B2 * | 2/2013 | Izawa et al. | 347/102 |
| 2007/0012209 | A1 * | 1/2007 | Ichimura | 101/424.1 |
| 2009/0225695 | A1 * | 9/2009 | Kang et al. | 370/315 |
| 2009/0226205 | A1 * | 9/2009 | Sato et al. | 399/101 |
| 2009/0244146 | A1 * | 10/2009 | Chiwata | 347/14 |
| 2011/0063389 | A1 * | 3/2011 | Hanson et al. | 347/102 |

* cited by examiner

*Primary Examiner* — Manish S Shah
*Assistant Examiner* — Jeremy Delozier
(74) *Attorney, Agent, or Firm* — Flynn, Thiel, Boutell & Tanis, P.C.

(57) ABSTRACT

The present invention is directed to an inkjet recording apparatus 100 capable of performing recording continuously on both surfaces of a web 1, including a plurality of recording heads H1 to H8 disposed on a substrate, driers 5*a* and 5*b* for drying the web 1 recorded by the recording heads H1 to H8, and guide rollers A1 to A8, B1 to B8, and G1 to G8 for guiding the web 1, in which a traveling path of the web 1 is switchable so that the web 1 passes between any selected adjacent ones of the recording heads H1 to H8, the recording head upstream of the position where the web passes performs recording on one surface 1*a* of the web 1, and the recording head downstream of the position where the web 1 passes performs recording on the other surface 1*b* of the web 1, and an inkjet recording method using the same.

9 Claims, 7 Drawing Sheets

INKJET RECORDING APPARATUS AND INKJET RECORDING METHOD USING THE SAME

TECHNICAL FIELD

The present invention relates to an inkjet recording apparatus and an inkjet recording method using the same, and more specifically, to an inkjet recording apparatus that can adjust the number of colors and can continuously perform recording on both surfaces of a web efficiently and an inkjet recording method using the same.

BACKGROUND ART

An inkjet recording system is generally used in a large number of fields because a desired design and letters can be recorded.

In recent years, a web having a design and letters recorded on both its surfaces using an inkjet recording system has been required.

A method for performing recording on both surfaces of a web using an inkjet recording system includes a badge type method for performing recording two times by the same inkjet recording apparatus.

An example is a method for performing recording on one surface of a web using an inkjet recording system, then reversing the web, and performing recording on the other surface of the web using the inkjet recording system.

However, such a badge type method is required to apply a large amount of ink depending on a design. Therefore, an image may bleed unless it is dried at once. Therefore, continuous recording cannot be performed, resulting in poor productivity.

On the other hand, an inkjet recording apparatus including two printing units and a drier has been known (see, e.g., Patent Document 1).

Such an inkjet recording apparatus can perform recording continuously on both surfaces of a web.

PRIOR ART DOCUMENTS

Patent Documents

Patent Document 1 Japanese Patent Application Laid-Open Publication No. 2002-234214

SUMMARY OF THE INVENTION

Problems that the Invention is to Solve

However, in a double-side printing apparatus discussed in the above-mentioned Patent Document 1, recording heads at four points are arranged for recording on one surface of the web. Therefore, five or more colors cannot be used. More specifically, the apparatus has a disadvantage in that versatile power of expression specific to "inkjet" is limited.

On the other hand, if only one color is used for recording on one surface of the web, the recording heads at the three points are left without being used. Therefore, the apparatus has the problem that a nozzle is dried and clogged, for example.

If the one surface is expressed in various ways in five or more colors, and only one to three colors are used for the other surface, such waste that a recording head that performs recording on the one surface is required to be annexed while the recording head that performs recording on the other surface is left without being used, which is not efficient. More specifically, the number of recording heads in the inkjet recording apparatus is increased as a while.

The present invention has been made in view of the above-mentioned circumstances, and is directed to providing an inkjet recording apparatus capable of adjusting the number of colors and efficiently performing recording continuously on both surfaces of a web and an inkjet recording method using the same.

Means for Solving the Problems

When the inventors of the present invention have earnestly made consideration to solve the above-mentioned problem, they have found out that the above-mentioned problem can be solved by making, to efficiently use disposed recording heads, a traveling path of a web that passes between the adjacent recording heads switchable, to complete the present invention.

More specifically, the present invention resides in (1) an inkjet recording apparatus capable of performing recording continuously on both surfaces of a web, including a plurality of recording heads disposed therein, a drier for drying the web recorded by the recording head, and a guide roller for guiding the web, in which a traveling path of the web is switchable so that the web passes between the selected adjacent recording heads, the recording head upstream of a position where the web passes performs recording on the one surface of the web, and the recording head downstream of the position where the web passes performs recording on the other surface of the web.

The present invention resides in (2) the inkjet recording apparatus described in the above-mentioned item (1) in which the drier includes a first drier for drying the one surface of the web, and a second drier for drying the other surface of the web.

The present invention resides in (3) the inkjet recording apparatus described in the above-mentioned item (2) in which, further including a plurality of additional recording heads disposed therein to perform recording on the one surface of the web.

The present invention resides in (4) the inkjet recording apparatus described in any one of the above-mentioned items (1) to (3) in which the guide roller comprises a plurality of guide rollers, and the guide roller is selected so that the travelling path is switchable.

The present invention resides in (5) the inkjet recording apparatus described in any one of the above-mentioned items (1) to (3) in which the guide roller is an adjustment guide roller that is slidable on a rail, and a position of the adjustment guide roller is changed so that the travelling path is switchable.

The present invention resides in (6) the inkjet recording apparatus described in any one of the above-mentioned items (1) to (5) in which lower surfaces of the plurality of recording heads are disposed in an arch shape.

The present invention resides in (7) the inkjet recording apparatus described in any one of the above-mentioned items (1) to (6) in which the drier is an ultraviolet drier.

The present invention resides in (8) an inkjet recording method using the inkjet recording apparatus described in the above-mentioned item (2), including steps of, drying the web by the first drier after the recording head upstream of the position where the web passes between the selected adjacent recording heads performs recording on one surface of the web, and drying the web by the second drier after the recording head downstream of the position where the web passes between the selected adjacent recording heads performs recording on the other surface of the web.

The present invention resides in (9) an inkjet recording method using the inkjet recording apparatus described in the above-mentioned item (3), including steps of, drying the web using a virtual drier after the additional recording head performs recording on the one surface of the web, drying the web by the first drier after the recording head upstream of a position where the web passes between the selected adjacent recording heads performs recording on the one surface of the web, and drying the web by the second drier after the recording head downstream of the position where the web passes between the selected adjacent recording heads performs recording on the other surface of the web.

Advantages of the Invention

In the inkjet recording apparatus according to the present invention, a web is passed between adjacent recording heads, the recording head upstream of a position where the web passes is caused to perform recording on one surface of the web, and the recording head downstream of the position where the web passes is caused to perform recording on the other surface of the web.

At this time, a traveling path through which the web is passed is switched so that the number of recording heads that is caused to perform recording on the one surface of the web and the number of recording heads that is caused to perform recording on the other surface of the web can be adjusted. More specifically, the numbers of colors used on the one surface and the other surface of the web can be adjusted.

This enables the number of recording heads that are not used to be reduced to zero or reduced, and at the same time enables such waste that a recording head is annexed to be cut if expression in various ways in five or more colors is used for the one surface and only one to three colors are used for the other surface.

Therefore, the above-mentioned inkjet recording apparatus can also deal with a difference in the number of colors between the one surface and the other surface of the web, and can efficiently perform recording continuously on both the surfaces of the web.

In the inkjet recording apparatus according to the present invention, if a plurality of guide rollers is arranged, and a traveling path is switchable by selecting the guide roller for guiding a web, the guide roller is positioned. Therefore, the traveling path can be easily selected depending on the number of colors based on a design.

If the guide roller is an adjustment guide roller that is slidable on a rail, and the traveling path is switchable by changing a position of the adjustment guide roller, a sensor can also perform control, and the traveling path can be selected more smoothly depending on the number of colors based on a design.

If the inkjet recording apparatus according to the present invention further includes a plurality of additional recording heads disposed therein to perform recording on one surface of the web, expression in various ways is further enabled.

In the inkjet recording apparatus according to the present invention, if the plurality of recording heads is disposed so that their lower surfaces have an arch shape, tension can be applied to the web in a direction opposite to the recording heads so that the web can be prevented from bustling.

In the inkjet recording apparatus according to the present invention, if the drier is a UV drier, a simple apparatus enables sufficient drying so that a space is saved.

In an inkjet recording method according to the present invention, the above-mentioned inkjet recording apparatus is used so that the number of colors can be adjusted, and recording can be efficiently performed continuously on both surfaces of the web.

If the inkjet recording apparatus includes the additional recording head, the drier can perform drying once so that a higher-quality inkjet record is obtained.

DESCRIPTION OF EMBODIMENTS

Figure 1:
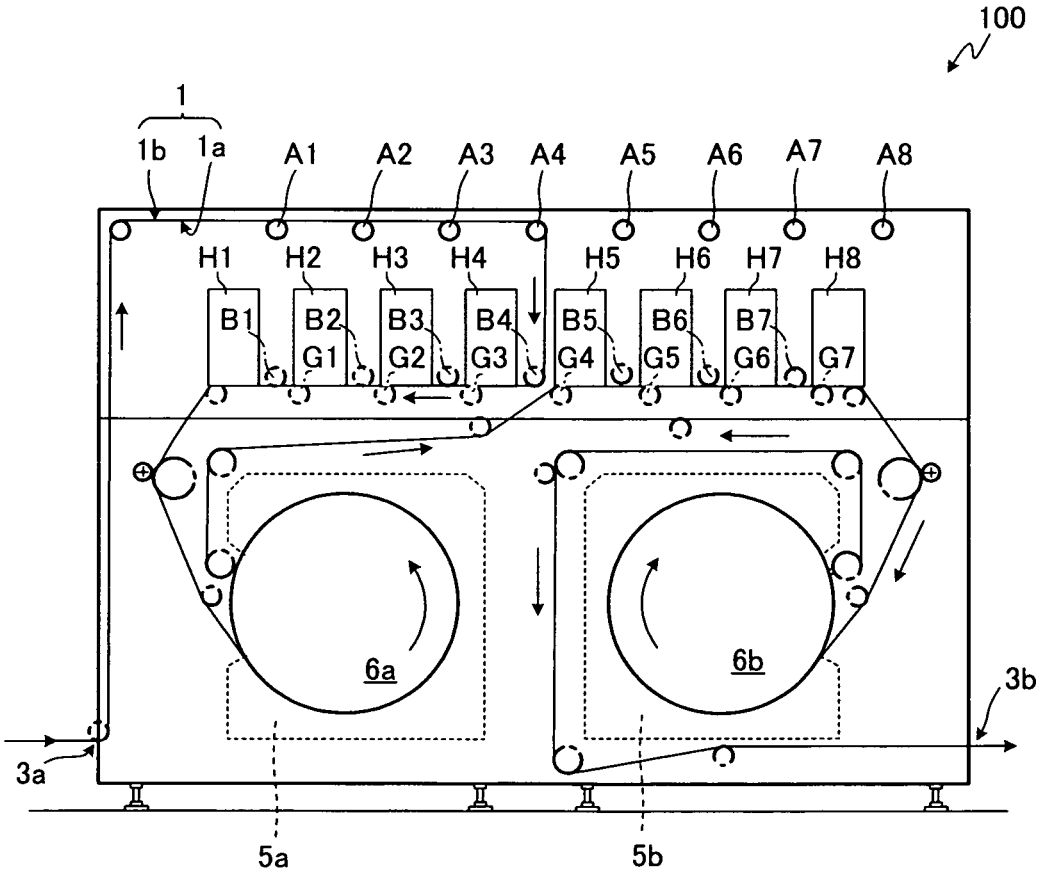
FIG. 1 is a schematic view illustrating a first embodiment of an inkjet recording apparatus according to the present invention.

Preferred embodiments of the present invention will be described in detail below while referring to figures, as needed. In the figures, the same elements are assigned the same reference numerals, and an overlapped description is omitted. A positional relationship such as the left, right, top and bottom is based on a positional relationship illustrated in the figures unless otherwise noted. Further, a dimensional ratio in the figures is not limited to a ratio as illustrated.

An inkjet recording apparatus according to the present invention includes a plurality of recording heads disposed on a substrate, a guide roller capable of guiding a web between the selected adjacent recording heads (hereinafter referred to as an "upper guide roller" for convenience), a guide roller capable of guiding the web to the recording head upstream of a position where the web passes (hereinafter referred to as a "left guide roller" for convenience), a guide roller capable of guiding the web to a recording head downstream of a position where the web passes (hereinafter referred to as a "right guide roller" for convenience), a drier for drying the web recorded by the recording head on the upstream side (hereinafter referred to as a "first drier" for convenience), and a drier for drying the web recorded by the recording head on the downstream side (hereinafter referred to as a "second drier" for convenience). More specifically, in the inkjet recording apparatus according to the present invention, the guide roller includes three guide rollers, i.e., the upper guide roller, the left guide roller, and the right guide roller.

In the inkjet recording apparatus according to the present invention, the web is passed between the adjacent recording heads, the recording head upstream of a position where the web passes is caused to perform recording on one surface of the web, and the recording head downstream of the position where the web passes is caused to perform recording on the other surface of the web.

At this time, the upper guide roller, the left guide roller, and the right guide roller to be used can be selected, as needed. More specifically, the guide roller is selected so that a traveling path is switchable.

First Embodiment

FIG. 1 is a schematic view illustrating a first embodiment of an inkjet recording apparatus according to the present invention.

As illustrated in FIG. 1, an inkjet recording apparatus 100 according to the first embodiment includes eight recording heads (a "first recording head" to an "eighth recording head" from the left of FIG. 1 for convenience) H1 to H8, an upper guide roller for guiding the web 1 between the fourth recording head H4 and the fifth recording head H5 (hereinafter also referred to as a "fourth upper guide roller" for convenience) A4, a left guide roller for guiding the web 1 toward the first recording head HI to the fourth recording head H4 (hereinafter also referred to as a "fourth left guide roller" for convenience) B4, a right guide roller for guiding the web 1 toward the fifth recording head H5 to the eighth recording head H8 (hereinafter also referred to as a "fourth right guide roller" for convenience) G4, a first drier 5*a* for drying one surface 1*a* of the web 1 recorded by the four recording heads from the first recording head HI to the fourth recording head H4, and a second drier 5*b* for drying the other surface 1*b* of the web 1 recorded by the four recording heads from the fifth recording head H5 to the eighth recording head H8.

In the inkjet recording apparatus 100, a plurality of upper guide rollers (hereinafter also referred to as a "first upper guide roller" to a "seventh upper guide roller" in the order from the left of FIG. 1 for convenience) A1 to A7, a plurality of left guide rollers (hereinafter also referred to as a "first left guide roller" to a "seventh left guide roller" in the order from the left of FIG. 1 for convenience) B1 to B7, and a plurality of right guide rollers (hereinafter also referred to as a "first right guide roller" to a "seventh right guide roller" in the order from the left of FIG. 1 for convenience) G1 to G7 are disposed to make the traveling path of the web 1 switchable.

In the inkjet recording apparatus 100 according to the first embodiment, the first recording head HI to the eighth recording head H8 are positionally-fixed to a substrate to line up. Therefore, the recording can be performed continuously for the web 1.

The first recording head HI to the eighth recording head H8 are detachably attached to the substrate, and can be replaced, as needed.

The first recording head HI to the eighth recording head H8 respectively contain inks. The inks may be in the same color or different colors. The inks may be a dye or a pigment, or may be water-based or oil-based.

When the recording heads that respectively contain inks in yellow, magenta, cyan, and black perform recording, full-color expression is enabled. The apparatus further includes recording heads that respectively contain inks with shadings of the colors. When all the recording heads perform recording, a range of colors that can be expressed is expanded. In addition thereto, liquids obtained by dissolving an ultraviolet curing agent, a glazing agent, a flame retardant, a ground agent, and so on may be used as the inks.

The first upper guide roller A1 to the seventh upper guide roller A7 and the first left guide roller B1 to the seventh left guide roller B7 are arranged between the first recording head H1 to the eighth recording head H8, and the first right guide roller G1 to the seventh right guide roller G7 are arranged under the first recording head H1 to the eighth recording head H8.

In the inkjet recording apparatus 100, a direction of travel of the web 1 is changed between the adjacent recording heads. In the inkjet recording apparatus 100, a substrate is provided with a hole so that the web 1 does not block a traveling path that passes between the adjacent recording heads.

The first upper guide roller A1 to the seventh upper guide roller A7, the first left guide roller B1 to the seventh left guide roller B7, and the first right guide roller G1 to the seventh right guide roller G7 are used to match one another. More specifically, if the fourth upper guide roller A4 guides the web 1, as described above, the fourth left guide roller B4 and the fourth right guide roller G4 are used. In this case, a recording head used for recording on one surface 1*a* of the web 1 includes the four recording heads, i.e., the first recording head H1 to the fourth recording head H4, and a recording head used for recording on the other surface 1*b* of the web 1 includes the four recording heads, i.e., the fifth recording head H5 to the eighth recording head H8.

A case where the traveling path of the web 1 is switched will be described herein.

Figure 2:
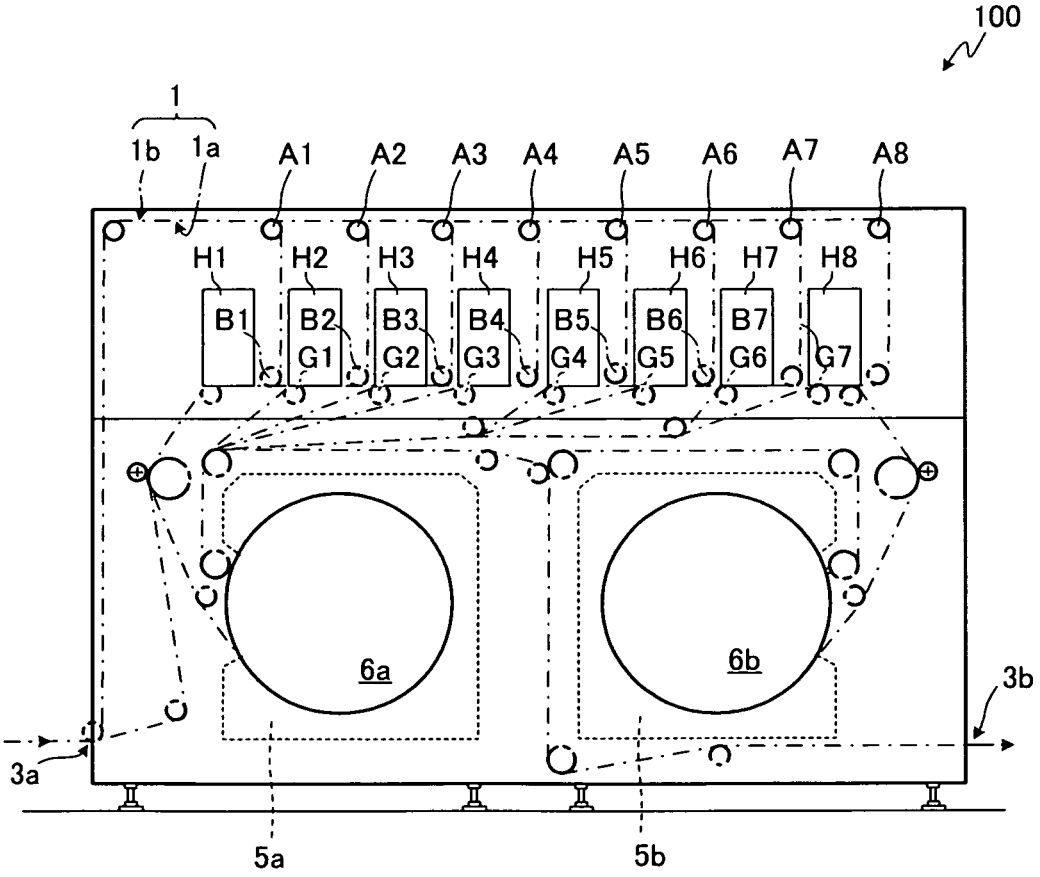
FIG. 2 is a schematic view illustrating a plurality of examples of a web traveling path in the first embodiment of the inkjet recording apparatus according to the present invention.

FIG. 2 is a schematic view illustrating a plurality of examples of a traveling path of a web in the first embodiment of the inkjet recording apparatus according to the present invention.

As illustrated in FIG. 2, if the first upper guide roller A1 guides the web 1, for example, a first left guide roller B1 and a first right guide roller G1 are used. In this case, the recording head used for recording on the one surface 1*a* of the web 1 includes one recording head, i.e., the first recording head H1, and a recording head used for recording on the other surface 1*b* of the web 1 includes seven recording heads, i.e., the second recording head H2 to the eighth recording head H8.

If the second upper guide roller A2 guides the web 1, the second left guide roller B2 and the second right guide roller G2 are used. In this case, a recording head used for recording on the one surface 1*a* of the web 1 includes two recording heads, i.e., the first recording head H1 and the second recording head H2, and a recording head used for recording on the other surface 1*b* of the web 1 includes six recording heads, i.e., the third recording head H3 to the eighth recording head H8.

If the third upper guide roller A3 guides the web 1, the third left guide roller B3 and the third right guide roller G3 are used. In this case, a recording head used for recording on the one surface 1*a* of the web 1 includes three recording heads, i.e., the first recording head H1 to the third recording head H3, and a recording head used for recording on the other surface 1*b* of the web 1 includes five recording heads, i.e., the fourth recording head H4 to the eighth recording head H8.

If the fifth upper guide roller A5 guides the web 1, the fifth left guide roller B5 and the fifth right guide roller G5 are used. In this case, a recording head used for recording on the one surface 1*a* of the web 1 includes five recording head, i.e., the first recording head H1 to the fifth recording head H5, and a recording head used for recording on the other surface 1*b* of the web 1 includes three recording heads, i.e., the sixth recording head H6 to the eighth recording head H8.

If the sixth upper guide roller A6 guides the web 1, the sixth left guide roller B6 and the sixth right guide roller G6 are used. In this case, a recording head used for recording on the one surface 1*a* of the web 1 includes six recording heads, i.e., the first recording head H1 to the sixth recording head H6, and a recording head used for recording on the other surface 1*b* of the web 1 includes two recording heads, i.e., the seventh recording head H7 and the eighth recording head H8.

If the seventh upper guide roller A7 guides the web 1, the seventh left guide roller B7 and the seventh right guide roller G7 are used. In this case, a recording head used for recording on the one surface 1*a* of the web 1 includes seven recording heads, i.e., the first recording head HI to the seventh recording head H7, and a recording head used for recording on the other surface 1*b* of the web 1 includes one recording head, i.e., the eighth recording head H8.

In the inkjet recording apparatus 100 according to the first embodiment, the first drier 5*a* and the second drier 5*b* are arranged below the first recording head H1 to the eighth recording head H8. Thus, an installation space of the inkjet recording apparatus 100 can be made compact.

The first drier 5*a* has a heating heater in its inner part, and a surface of a drum 6*a* is heated by its heat. The first drier 5*a* is provided with a spray nozzle (not illustrated). The spray nozzle sprays hot air onto the surface of the drum 6*a*. More specifically, the first drier 5*a* dries the one surface 1*a* of the web 1 wound around the surface of the drum 6*a* using two drying functions. The second drier 5*b* has the same structure as that of the first drier 5*a*.

In the inkjet recording apparatus according to the first embodiment, a material for the web 1 includes, but is not limited to, paper, a fabric, a film, a metal foil and the like.

The web 1 continuously travels.

An inkjet recording method using the inkjet recording apparatus 100 according to the first embodiment will be described below.

In such an inkjet recording method, the recording head upstream of a position where the web 1 passes between the adjacent recording heads performs recording on the one surface 1*a* of the web, and the first drier 5*a* then dries the web 1, and the recording head downstream of the position where the web 1 passes between the recording heads performs recording on the other surface 1*b* of the web 1, and the second drier 5*b* then dries the web 1.

More specifically, the web 1, which has been carried in from a carry-in port 3*a* of the inkjet recording apparatus 100, is guided to pass above the first recording head H1 to the fourth recording head H4 once and pass between the fourth recording head H4 and the fifth recording head H5 by the fourth upper guide roller A4.

The fourth left guide roller B4 then guides the web 1 toward the first recording head H1 to the fourth recording head H4, and the first recording head H1 to the fourth recording head H4 sequentially perform recording on the one surface 1*a* of the web 1.

Then, the web 1 is guided to the first drier 5*a* arranged below, and is wound around the drum 6*a* to almost go around its circumference, and the one surface 1*a* of the web 1 is dried. At this time, a surface opposite to the one surface 1*a*, on which recording has been performed, of the web 1 contacts the drum 6*a*. Thus, the web 1 is efficiently dried, and contamination of the drum is also suppressed.

The fourth right guide roller G4 then guides the web 1 toward the fifth recording head H5 to the eighth recording head H8, and the fifth recording head H5 to the eighth recording head H8 are used to sequentially perform recording on the other surface 1*b* of the web 1.

Then, the web 1 is guided to the second drier 5*b* arranged below, and is wound around a drum 6*b* to almost go around its circumference, and the other surface 1*b* of the web 1 is dried. At this time, a surface opposite to the other surface 1*b*, on which recording has been performed, of the web 1 contacts the drum 6*b*. Thus, the web 1 is efficiently dried, and contamination of the drum is also suppressed.

The web 1 is carried out of a carry-out port 3*b* of the inkjet recording apparatus 100.

Thus, recording is continuously performed on both surfaces of the web 1.

In the inkjet recording method, examples of a method for carrying in the web 1 include a method for carrying in the web 1 wound around a winding roller, for example, into the inkjet recording apparatus 100. An example of a method for carrying out the web 1 includes a method for carrying out the recorded web 1 by winding the web 1 around a winding roller.

As described above, in the inkjet recording apparatus 100 according to the first embodiment, a plurality of guide rollers is arranged, the guide roller for guiding the web 1 is selected, as needed, so that a traveling path is switchable. Thus, the traveling path can be easily selected depending on the number of colors based on a design.

Accordingly, the inkjet recording apparatus 100 according to the first embodiment and the inkjet recording method using the same, the number of colors can be adjusted, and recording can be efficiently performed continuously on both surfaces of the web.

Second Embodiment

Figure 3:
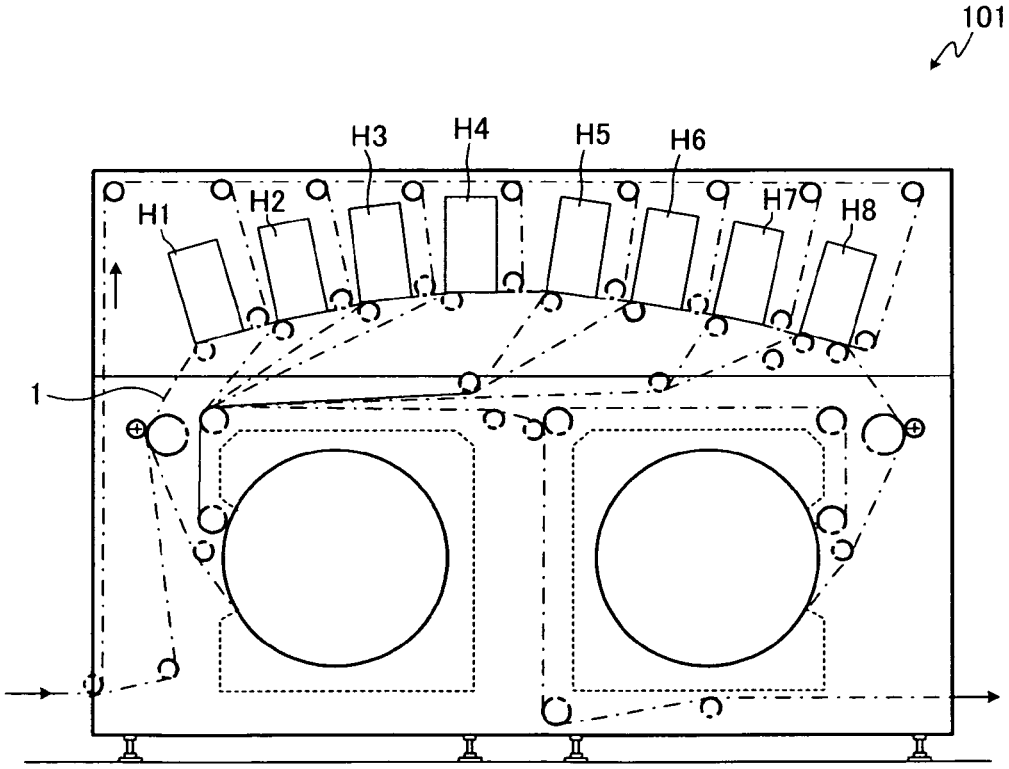
FIG. 3 is a schematic view illustrating a plurality of examples of a web traveling path in a second embodiment of the inkjet recording apparatus according to the present invention.

FIG. 3 is a schematic view illustrating a plurality of examples of a traveling path of a web in a second embodiment of an inkjet recording apparatus according to the present invention.

As illustrated in FIG. 3, an inkjet recording apparatus 101 according to the second embodiment is the same as the inkjet recording apparatus 100 according to the first embodiment except that a plurality of recording heads is disposed so that their lower surfaces have an arch shape.

In the inkjet recording apparatus 101 according to the second embodiment, the plurality of recording heads is disposed so that their lower surfaces have an arch shape. Therefore, tension can be applied to the web 1 in a direction opposite to the recording heads. Thus, the web 1 can be prevented from bustling, the occurrence of problems such as clogging of recording heads H1 to H8 by contact between the recording heads H1 to H8 and the web 1 and contamination of the web 1 is suppressed.

Third Embodiment

Figure 4:
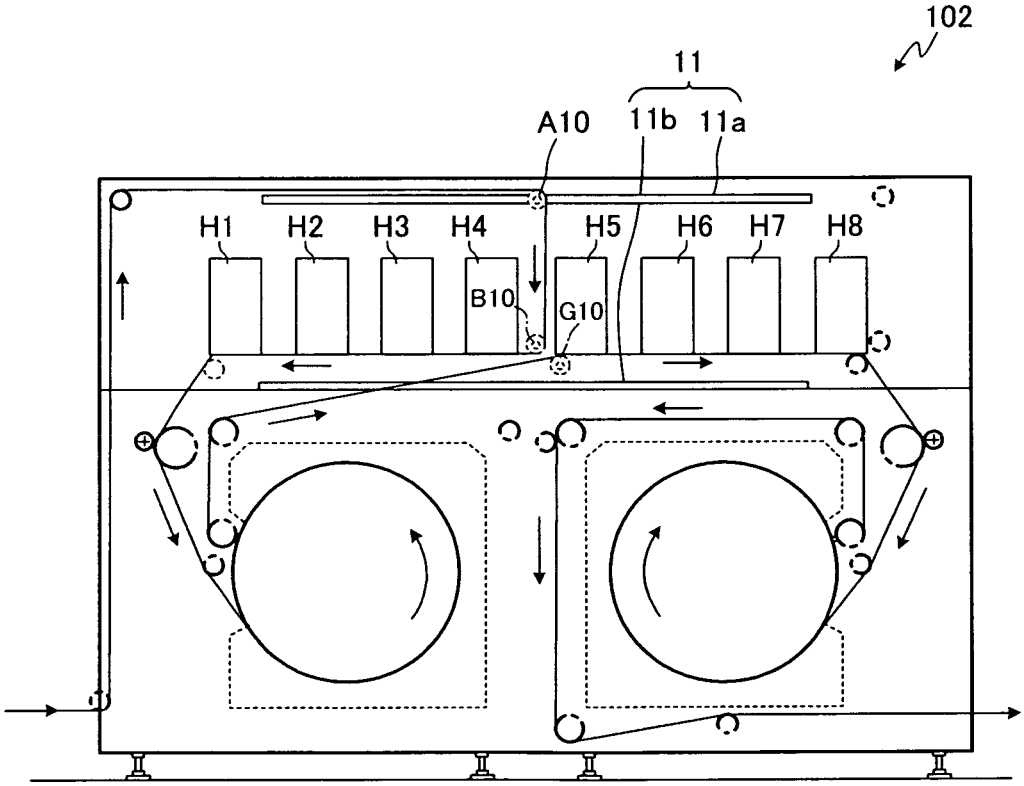
FIG. 4 is a schematic view illustrating a third embodiment of the inkjet recording apparatus according to the present invention.

FIG. 4 is a schematic view illustrating a third embodiment of an inkjet recording apparatus according to the present invention.

As illustrated in FIG. 4, an inkjet recording apparatus 102 according to the third embodiment is the same as the inkjet recording apparatus 100 according to the first embodiment except that it further includes an adjustment guide roller (hereinafter also referred to as an "upper adjustment guide roller" for convenience) A10 as an alternative to the plurality of upper guide rollers A1 to A7, an adjustment guide roller (hereinafter also referred to as a "left adjustment guide roller" for convenience) B10 as an alternative to the plurality of left guide rollers B1 to B7, an adjustment guide roller (hereinafter also referred to as a "right adjustment guide roller" for convenience) G10 as an alternative to the plurality of right guide rollers G1 to G7, an upper rail 11*a* to which the upper adjustment guide roller A10 is slidably attached, and a lower rail lib to which the left adjustment guide roller B10 and the right adjustment guide roller G10 are slidably attached. More specifically, the inkjet recording apparatus 102 according to the third embodiment differs from the inkjet recording apparatus 100 according to the first embodiment in that it replaces the upper guide rollers A1 to A7 with one slidable upper adjustment guide roller A10, replaces the left guide rollers B1 to B7 with one slidable left adjustment guide roller B10, and replaces the right guide rollers G1 to G7 with one slidable right adjustment guide roller G10, and further includes a pair of rails 11 (an upper rail 11*a* and a lower rail 11*b*).

Therefore, in the inkjet recording apparatus 102 according to the third embodiment, the adjustment guide roller includes three guide rollers, i.e., an upper adjustment guide roller, a left adjustment guide roller, and a right adjustment guide roller.

The upper adjustment guide roller A10, the left adjustment guide roller B10, and the right adjustment guide roller G10 slide integrally with one another. If the web 1 is guided between the fourth recording head H4 and the fifth recording head H5, for example, the upper adjustment guide roller A10 may be slid to and located at a position corresponding to the above-mentioned fourth upper guide roller A4, the left adjustment guide roller B10 may be slid to and located at a position corresponding to the above-mentioned fourth left guide roller B4, and the right adjustment guide roller G10 may be slid to and located at a position corresponding to the above-mentioned fourth right guide roller G4. If a traveling path of a web 1 is desired to be switched to another position, the upper adjustment guide roller A10, the left adjustment guide roller B10, and the right adjustment guide roller G10 may be similarly slid to and located at a predetermined position.

In the inkjet recording apparatus 102 according to the third embodiment, the upper adjustment guide roller A10, the left adjustment guide roller B10, and the right adjustment guide roller G10 are integrally slid to change their positions so that the traveling path is switchable. Therefore, the traveling path can be more smoothly selected depending on the number of colors based on a design.

The slides of the upper adjustment guide roller A10, the left adjustment guide roller B10, and the right adjustment guide roller G10 can also be controlled by a sensor. The slides of the guide rollers may be separately controlled and synchronously located. Alternatively, they may be synchronously located integrally under the same control.

Fourth Embodiment

Figure 5:
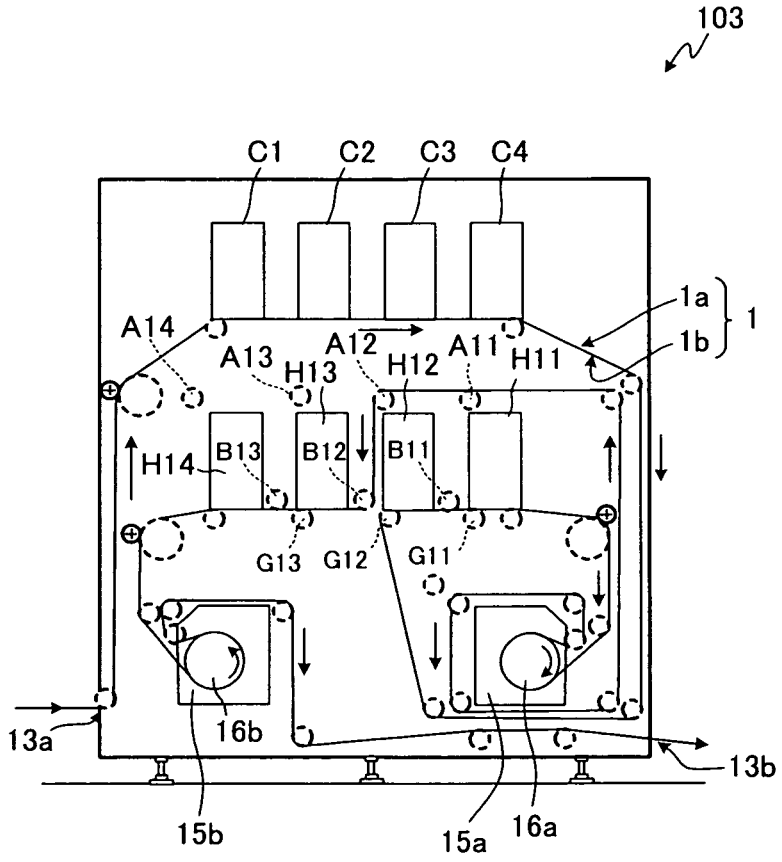
FIG. 5 is a schematic view illustrating a fourth embodiment of the inkjet recording apparatus according to the present invention.

FIG. 5 is a schematic view illustrating a fourth embodiment of an inkjet recording apparatus according to the present invention.

As illustrated in FIG. 5, an inkjet recording apparatus 103 according to the fourth embodiment includes four additional recording heads C1 to C4 disposed to perform recording on one surface 1*a* of a web 1. More specifically, the inkjet recording apparatus 103 according to the fourth embodiment includes four recording heads (hereinafter also referred to as an "eleventh recording head" to a "fourteenth recording head" in the order from the right of FIG. 4 for convenience) H11 to H14 disposed on a substrate (not illustrated), a right guide roller (hereinafter also referred to as a "twelfth right guide roller" for convenience) G12 for guiding the web 1 toward the eleventh recording head H11 and the twelfth recording head H12, an upper guide roller (hereinafter also referred to as a "twelfth upper guide roller" for convenience) A12 for guiding the web 1 between the twelfth recording head H12 and the thirteenth recording head H13, a left guide roller (hereinafter also referred to as a "twelfth left guide roller" for convenience) B12 for guiding the web 1 toward the thirteenth recording head H13 and the fourteenth recording head H14, four additional recording heads C1 to C4, a first drier 15*a* for drying one surface 1*a* of the web 1 recorded by the two recording heads, i.e., the eleventh recording head H1*l* and the twelfth recording head H12, and a second drier 15*b* for drying the other surface 1*b* of the web 1 recorded by the two recording heads, i.e., the thirteenth recording head H13 and the fourteenth recording head H14.

In the inkjet recording apparatus 103, a plurality of upper guide rollers (hereinafter also referred to as an "eleventh upper guide roller" to a "thirteenth upper guide roller" in the order from the right of FIG. 4 for convenience) A11 to A13, a plurality of left guide rollers (hereinafter also referred to as an "eleventh left guide roller" to a "thirteenth left guide roller" in the order from the right of FIG. 4 for convenience) B11 to B13, and a plurality of right guide rollers (hereinafter also referred to as an "eleventh right guide roller" to a "thirteenth right guide roller" in the order from the right of FIG. 4 for convenience) G11 to G13 are disposed in order to make a traveling path of the web 1 switchable.

In the inkjet recording apparatus 103 according to the fourth embodiment, the additional recording heads C1 to C4 and the eleventh recording head H11 to the fourteenth recording head H14 are positionally-fixed to a substrate (not illustrated) to respectively line up. Therefore, the recording can be continuously performed for the web 1.

The additional recording heads C1 to C4 and the eleventh recording head H1*l* to the fourteenth recording head H14 are detachably attached to the substrate, and can be respectively replaced, as needed.

The additional recording heads C1 to C4 and the eleventh recording head H11 to the fourteenth recording head H14 contain inks, respectively, similarly to the above-mentioned recording heads H1 to H8. The inks may be in the same color or different colors. The inks may be a dye or a pigment, or may be water-based or oil-based.

The eleventh upper guide roller A11 to the thirteenth upper guide roller A13 and the eleventh left guide roller B11 to the thirteenth left guide roller B13 are arranged among the eleventh recording head H11 to the fourteenth recording head H14, and the eleventh right guide roller G11 to the thirteenth right guide roller G13 are arranged below the eleventh recording head H11 to the thirteenth recording head H13. More specifically, the recording heads change a traveling direction of the web 1. In the inkjet recording apparatus 103, the substrate is provided with a hole not to prevent the traveling path in which the web 1 passes between the adjacent recording heads.

The eleventh upper guide roller A11 to the thirteenth upper guide roller A13, the eleventh left guide roller B11 to the thirteenth left guide roller B13, the eleventh right guide roller G11 to the thirteenth right guide roller G13 are used to match one another. More specifically, if the twelfth right guide roller G12 guides the web 1, as described above, the twelfth upper guide roller A12 and the twelfth left guide roller B12 are used. In this case, a recording head used for recording on one surface 1*a* of the web 1 includes six recording heads, i.e., additional recording heads C1 to C4 and the eleventh recording head H11 and the twelfth recording head H12. A recording head used for recording on the other surface 1*b* of the web 1 includes two recording heads, i.e., the thirteenth recording head H13 and the fourteenth recording head H14.

A case where the traveling path of the web 1 is switched will be described herein.

Figure 6:
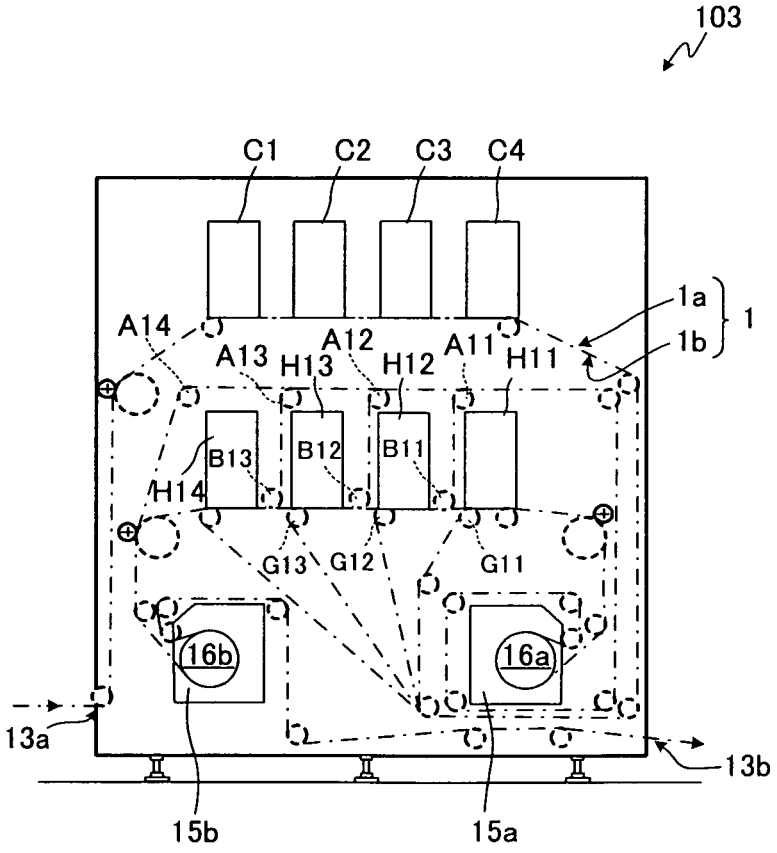
FIG. 6 is a schematic view illustrating a plurality of examples of a web traveling path in the fourth embodiment of the inkjet recording apparatus according to the present invention.

FIG. 6 is a schematic view illustrating a plurality of examples of the traveling path of the web in the fourth embodiment of the inkjet recording apparatus according to the present invention.

As illustrated in FIG. 6, if the eleventh right guide roller G11 guides the web 1, for example, the eleventh upper guide roller A11 and the eleventh left guide roller B11 are used. In this case, a recording head used for recording on the one surface 1*a* of the web 1 includes five recording heads, i.e., the additional recording heads C1 to C4 and the eleventh recording head H11, and a recording head used for recording on the other surface 1*b* of the web 1 includes three recording heads, i.e., the twelfth recording head H12 to the fourteenth recording head H14.

If the thirteenth right guide roller G13 guides the web 1, the thirteenth upper guide roller A13 and the thirteenth left guide roller B13 are used. In this case, a recording head used for recording on the one surface 1*a* of the web 1 includes seven recording heads, i.e., the additional recording heads C1 to C4 and the eleventh recording head H11 to the thirteenth recording head H13, and a recording head used for recording on the other surface 1*b* of the web 1 includes one recording head, i.e., the fourteenth recording head HI4.

In the inkjet recording apparatus 103 according to the fourth embodiment, a first drier 15*a* and a second drier 15*b* are arranged below the eleventh recording head H1*l* to the fourteenth recording head H14. Thus, an installation space of the inkjet recording apparatus 103 can be made compact. The first drier 15*a* and the second drier 15*b* have the same configuration as that of the first drier 5*a* in the inkjet recording apparatus 100 according to the first embodiment.

An inkjet recording method using the inkjet recording apparatus 103 according to the fourth embodiment will be described below.

In this inkjet recording method, the additional recording heads C1 to C4 perform recording on the one surface 1*a* of the web 1, the recording head upstream of a position where the web 1 continuously passes between the adjacent recording heads performs recording on the one surface 1*a* of the web 1, the first drier 15*a* then dries the web 1, the recording head downstream of the position where the web 1 passes between the recording heads performs recording on the other surface 1*b* of the web 1, and the second drier 15*b* then dries the web 1.

More specifically, the web 1 carried in from a carry-in port 13*a* of the inkjet recording apparatus 103 is guided to the additional recording heads C1 to C4, and the additional recording heads CI to C4 sequentially perform recording on the one surface 1*a* of the web.

Then, the web 1 is guided to below the eleventh recording head H1*l* to the fourteenth recording heads H14, and is guided toward the eleventh recording head H11 and the twelfth recording head H12 by the twelfth right guide roller G12, and the eleventh recording head H11 and the twelfth recording head H12 further sequentially perform recording on the one surface 1*a* of the web 1.

Then, the web 1 is guided to the first drier 15*a* arranged below, and is wound around the drum 16*a* to almost go around its circumference so that the one surface 1*a* of the web 1 is dried. At this time, a surface opposite to the one surface 1*a*, on which recording has been performed, of the web 1 contacts the drum 16*a*. Thus, the web 1 is efficiently dried, and contamination of the drum is also suppressed.

Then, the web 1 is guided to above the eleventh recording head H11 to the fourteenth recording head H14, and the twelfth upper guide roller A12 guides the web 1 to pass between the twelfth recording head H12 and the thirteenth recording head H13.

Then, the twelfth left guide roller B12 guides the web 1 toward the thirteenth recording head H13 and the fourteenth recording head H14, and the thirteenth recording head H13 and the fourteenth recording head H14 sequentially perform recording on the other surface 1*b* of the web 1.

Then, the web 1 is guided toward the second drier 15*b* arranged below, and is wound around the drum 16*b* to almost go around its circumference so that the other surface 1*b* of the web 1 is dried. At this time, a surface opposite to the other surface 1*b*, on which recording has been performed, of the web 1 contacts the drum 16*b*. Thus, the web 1 is efficiently dried, and contamination of the drum is also suppressed.

The web 1 is carried out of a carry-out port 13*b* in the inkjet recording apparatus 103.

Thus, recording is continuously performed on both surfaces of the recording medium 1.

The inkjet recording apparatus 103 according to the fourth embodiment includes a plurality of additional recording heads C1 to C4 disposed to perform recording on the one surface 1*a* of the web 1 so that expression in various ways is further enabled.

While the embodiments of the present invention have been described above, the present invention is not limited to the above-mentioned embodiments.

While in the inkjet recording apparatus 100 according to the first embodiment, the inkjet recording apparatus 101 according to the second embodiment, and the inkjet recording apparatus 102 according to the third embodiment, eight recording heads are used, the present invention is not limited to this, provided that the number of recording heads is two or more. For example, it may be seven or less or nine or more.

Similarly, while in the inkjet recording apparatus 103 according to the fourth embodiment, four additional recording heads are used, the present invention is not limited to this, provided that the number of recording heads is one or more. While the four recording heads are used, the present invention is not limited to this, provided that the number of recording heads is two or more. For example, it may be three or less or five or more.

In the inkjet recording apparatus 100 according to the first embodiment and the inkjet recording apparatus 101 according to the second embodiment, an eighth upper guide roller A8 may be further provided outside the seventh upper guide roller A7 (on the opposite side of the sixth upper guide roller A6) (see FIG. 1). In this case, the eighth upper guide roller A8 is caused to guide the web 1 so that eight recording heads H1 to H8 can perform recording on the one surface 1*a* of the web 1. At this time, recording is not performed on the other surface 1*b* of the web. In the inkjet recording apparatus 102 according to the third embodiment, a rail 11 is extended to a position corresponding to the above-mentioned eighth upper guide roller A8 so that the upper adjustment guide roller A10, the left adjustment guide roller B10, and the right adjustment guide roller G10 may be slidable to the position.

Further, in the inkjet recording apparatus 103 according to the fourth embodiment, a fourteenth upper guide roller A14 may be further provided outside the thirteenth upper guide roller A13 (on the opposite side of the twelfth upper guide roller A12) (see FIG. 6). In this case, the fourteenth upper guide roller A14 is also caused to guide the web 1 so that the four additional recording heads C1 to C4 and the four recording heads H11 to H14 can perform recording on the one surface 1*a* of the web 1. At this time, recording is not performed on the other surface 1*b* of the web.

The first upper guide roller A1 to the seventh upper guide roller A7, the first left guide roller B1 to the seventh left guide roller B7, and the first right guide roller G1 to the seventh right guide roller G7 are used to match one another. More specifically, if the fourth upper guide roller A4 guides the web 1, as described above, the fourth left guide roller B4 and the fourth right guide roller G4 are used. In this case, a recording head used for recording on the one surface 1*a* of the web 1 includes four recording heads, i.e., the first recording head H1 to the fourth recording head H4, and a recording head used for recording on the other surface 1*b* of the web 1 includes four recording heads, i.e., the fifth recording head H5 to the eighth recording head H8.

In the inkjet recording apparatus 100 according to the first embodiment, a recording head that is not used may be provided. If the fourth upper guide roller A4 guides the web 1, for example, the number of recording heads used for recording on the other surface 1*b* of the web 1 can be four or less. More specifically, after the fourth upper guide roller A4 guides the web 1 between the fourth recording head H4 and the fifth recording head H5, and the fourth left guide roller B4 guides the web 1 between the first recording head H1 and the fourth recording head H4, to perform recording, and not the fourth right guide roller G4 but the fifth right guide roller G5 guides the web 1 so that three recording heads, i.e., the sixth recording head H6 to the eighth recording head H8 perform recording. At this time, the fifth recording head H5 is not used. The same is true for a case where the other upper guide rollers A1 to A7 guide the web 1. The right guide rollers B1 to B7 can also be selected, as needed, depending on the number of colors on the other surface 1*b*.

In the inkjet recording apparatus 102 according to the third embodiment and the inkjet recording apparatus 103 according to the fourth embodiment, the recording heads are disposed in a planar shape, the recording head may be disposed so that its lower surface has an arch shape, similarly to the recording head in the inkjet recording apparatus 101 according to the second embodiment. The additional recording heads C1 to C4 in the inkjet recording head 103 according to the fourth embodiment may also be disposed so that their lower surfaces have an arch shape.

While in the inkjet recording apparatus 103 according to the fourth embodiment, a substrate on which the additional recording heads C1 to C4 are disposed and a substrate on which the recording heads H11 to H14 are disposed are of a type including two stages, they may be of a type including three or more stages. More specifically, a substrate on which additional recording heads are disposed may be further annexed.

In the inkjet recording apparatus 103 according to the fourth embodiment, the additional recording heads C1 to C4 may perform recording on the one surface 1*a* of the web 1, followed by temporary drying once.

Figure 7:
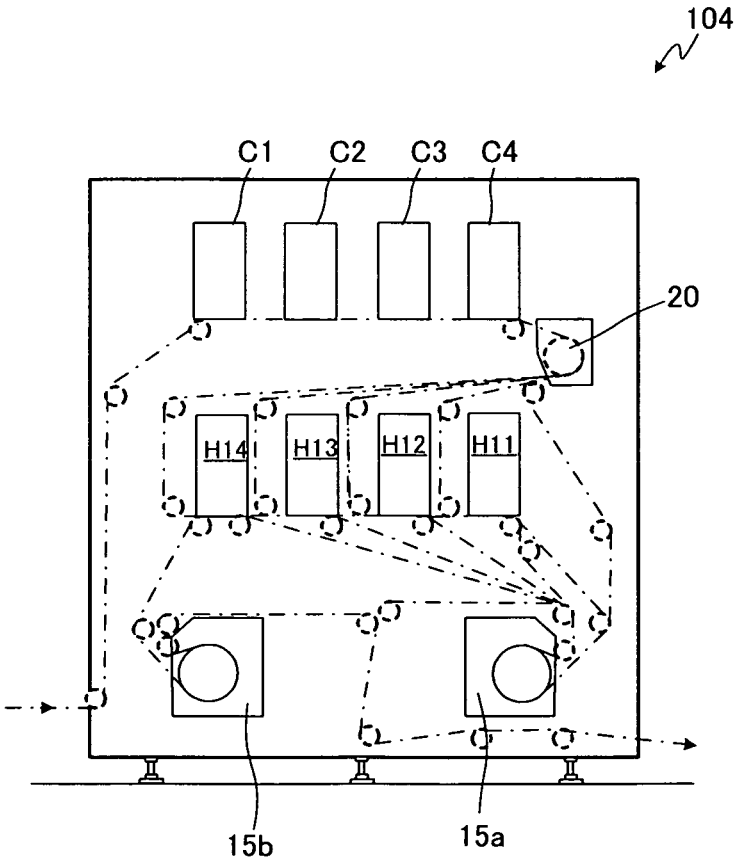
FIG. 7 is a schematic view illustrating another embodiment of the inkjet recording apparatus according to the present invention.

FIG. 7 is a schematic view illustrating another embodiment of the inkjet recording apparatus according to the present invention. As illustrated in FIG. 7, an inkjet recording apparatus 104 is the same as the inkjet recording apparatus 103 according to the fourth embodiment except that it includes a temporary drier 20 for performing temporary drying once after the additional recording heads C1 to C4 perform recording. The temporary drier 20 has the same configuration as that of the first drier 5*a* in the inkjet recording apparatus 100 according to the first embodiment.

In the inkjet recording apparatus 104, additional recording heads C1 to C4 perform recording on the one surface 1*a* of the web 1, followed by temporary drying once by the temporary drier 20, an eleventh recording head H11 and a twelfth recording head H12 upstream of a position where the web 1 passes between the twelfth recording head H12 and a thirteenth recording head H13 perform recording on the one surface 1*a* of the web 1, and a first drier 15*a* then dries the web 1.

The thirteenth recording head H13 and a fourteenth recording head H14 downstream of a position where the web 1 passes between the twelfth recording head H12 and the thirteenth recording head H13 perform recording on the other surface 1*b* of the web 1, and a second drier 15*b* then dries the web 1.

In the inkjet recording apparatus 104, the temporary drier thus dries the web 1 once so that a path for bringing a recording surface into contact with a guide roller is enabled, to obtain a simple sheet-passing path.

While in the inkjet recording apparatuses according to the first to fourth embodiments, the drier is of a drum type. If ink includes an ultraviolet curing agent, however, a UV drier may be used. In this case, a simple apparatus can sufficiently perform drying. Therefore, the apparatus has the advantage that a space is saved.

INDUSTRIAL APPLICABILITY

In an inkjet recording apparatus according to the present invention can be used as an apparatus for performing recording on both surfaces of a web using an inkjet system. This inkjet recording apparatus enables the number of colors to be adjusted and enables recording to be efficiently performed continuously on both the surfaces of the web.

DESCRIPTION OF REFERENCE NUMERALS

1 web
1*a* one surface
1*b* other surface
3*a*, 13*a* carry-in port
3*b*, 13*b* carry-out port
5*a*, 15*a* first drier (dryer)
5*b*, 15*b* second drier (dryer)
6*a*, 6*b*, 16*a*, 16*b* drum
11 rail
11*a* upper rail
11*b* lower rail
20 virtual drier
100, 101, 102, 103, 104 inkjet recording apparatus
A1 first upper guide roller (guide roller)
A2 second upper guide roller (guide roller)
A3 third upper guide roller (guide roller)
A4 fourth upper guide roller (guide roller)
A5 fifth upper guide roller (guide roller)
A6 sixth upper guide roller (guide roller)
A7 seventh upper guide roller (guide roller)
A10 upper adjustment guide roller (guide roller)
A11 eleventh upper guide roller (guide roller)
A12 twelfth upper guide roller (guide roller)
A13 thirteenth upper guide roller (guide roller)
B1 first left guide roller (guide roller)
B2 second left guide roller (guide roller)
B3 third left guide roller (guide roller)
B4 fourth left guide roller (guide roller)
B5 fifth left guide roller (guide roller)
B6 sixth left guide roller (guide roller)
B7 seventh left guide roller (guide roller)
B10 left adjustment guide roller (guide roller)
B11 eleventh left guide roller (guide roller)
B12 twelfth left guide roller (guide roller)
B13 thirteenth left guide roller (guide roller)

C1, C2, C3, C4 additional recording head
G1 first right guide roller (guide roller)
G2 second right guide roller (guide roller)
G3 third right guide roller (guide roller)
G4 fourth right guide roller (guide roller)
G5 fifth right guide roller (guide roller)
G6 sixth right guide roller (guide roller)
G7 seventh right guide roller (guide roller)
G10 right adjustment guide roller (guide roller)
G11 eleventh right guide roller (guide roller)
G12 twelfth right guide roller (guide roller)
G13 thirteenth right guide roller (guide roller)
H1 first recording head (recording head)
H2 second recording head (recording head)
H3 third recording head (recording head)
H4 fourth recording head (recording head)
H5 fifth recording head (recording head)
H6 sixth recording head (recording head)
H7 seventh recording head (recording head)
H8 eighth recording head (recording head)
H11 eleventh recording head (recording head)
H12 twelfth recording head (recording head)
H13 thirteenth recording head (recording head)
H14 fourteenth recording head (recording head)

The invention claimed is:

1. An inkjet recording apparatus capable of performing recording continuously on both surfaces of a web, comprising:

a plurality of recording heads disposed therein;

a drier for drying the web recorded by the recording head; and guide rollers for guiding the web, wherein the guide rollers include an upper guide roller for guiding a web downward between selected adjacent recording heads when the web is located above a recording head, a left guide roller for guiding the web leftward to a recording head upstream of a position where the web passes and a right guide roller for guiding the web rightward to a recording head downstream of a position where the web passes, the guide rollers including a plurality of upper guide rollers, a plurality of left guide rollers, and a plurality of right guide rollers, the web switches its traveling path by being guided by a selected one of the upper guide rollers, the left guide rollers and the right guide rollers, so that the web passes between the selected adjacent recording heads, the recording head upstream of a position where the web passes performs recording on one surface of the web, the recording head downstream of the position where the web 1 passes performs recording on an opposite surface of the web, and a traveling path through which the web is passed is switched so that the number of recording heads that is caused to perform recording on the one surface of the web and the number of recording heads that is caused to perform recording on the opposite surface of the web can be varied.

2. The inkjet recording apparatus according to claim 1, wherein the drier includes a first drier for drying the one surface of the web, and a second drier for drying the opposite surface of the web.

3. The inkjet recording apparatus according to claim 2, further including a plurality of additional recording heads disposed therein to perform recording on the one surface of the web.

4. The inkjet recording apparatus according to claim 1, wherein lower surfaces of the plurality of recording heads are disposed in an arch shape.

5. The inkjet recording apparatus according to claim 1, wherein the drier is an ultraviolet drier.

6. An inkjet recording method using the inkjet recording apparatus according to claim 2, comprising:

drying the web by the first drier after the recording head upstream of the position where the web passes between the selected adjacent recording heads performs recording on the one surface of the web, and drying the web by the second drier after the recording head downstream of the position where the web passes between the selected adjacent recording heads performs recording on the opposite surface of the web.

7. An inkjet recording method using the inkjet recording apparatus according to claim 3, comprising:

drying the web using a virtual drier after at least one of the additional recording heads performs recording on the one surface of the web, drying the web by the first drier after the recording head upstream of a position where the web passes between the selected adjacent recording heads performs recording on the one surface of the web, and drying the web by the second drier after the recording head downstream of the position where the web passes between the selected adjacent recording heads performs recording on the other surface of the web.

8. The inkjet recording apparatus according to claim 1, wherein the recording heads are positionally-fixed to a substrate to respectively line up, and the recording heads are detachably attached to the substrate.

9. The inkjet recording apparatus according to claim 1, wherein the recording heads are positionally-fixed to a substrate to respectively line up, and the substrate is provided with a hole to not prevent a traveling path in which the web passes between the adjacent recording heads.

* * * * *